US009010778B1

(12) United States Patent
Burns

(10) Patent No.: US 9,010,778 B1
(45) Date of Patent: Apr. 21, 2015

(54) LARGE WHEEL, LOW CENTER OF GRAVITY CASTERBOARD SYSTEM

(71) Applicant: Eric Burns, Palm Harbor, FL (US)

(72) Inventor: Eric Burns, Palm Harbor, FL (US)

( * ) Notice: Subject to any disclaimer, the term of this patent is extended or adjusted under 35 U.S.C. 154(b) by 0 days.

(21) Appl. No.: 14/341,277

(22) Filed: Jul. 25, 2014

(51) Int. Cl.
*B62M 1/00* (2010.01)
*A63C 17/00* (2006.01)

(52) U.S. Cl.
CPC ..... *A63C 17/0033* (2013.01)

(58) Field of Classification Search
USPC ..... 280/87.042, 87.04–87.05, 11.28
See application file for complete search history.

(56) References Cited

U.S. PATENT DOCUMENTS 5,458,351 A * 10/1995 Yu ..... 280/87.042
6,059,303 A * 5/2000 Bradfield ..... 280/87.042
6,511,083 B1 * 1/2003 Tsai ..... 280/87.041
7,325,819 B2 * 2/2008 Kwak ..... 280/87.042
7,367,572 B2 * 5/2008 Jiang ..... 280/87.042

* cited by examiner

*Primary Examiner* — John Walters
*Assistant Examiner* — James Triggs

(57) ABSTRACT

A forward board has a forward foot placement section, a wheel arch section with a high point, a forward caster mount section extending rearwardly and upwardly from the forward end of the forward board. A rearward board has a rearward foot placement section, a rearward caster mount section extending forwardly and downwardly from the rearward end of the rearward board. A connector/torque assembly couples the forward and rearward boards and includes a longitudinal pivot/connecting rod, a torsion spring. A forward wheel with a forward caster is rotatable about a first axis positioned beneath the high point of the front wheel arch section. A rearward wheel with a rearward caster is rotatable about a third axis positioned rearwardly of the rearward board. The foot placement sections are in a common plane extending through the wheels above the first and third axes when the wheels are in a neutral forward position.

6 Claims, 3 Drawing Sheets

FIG. 3
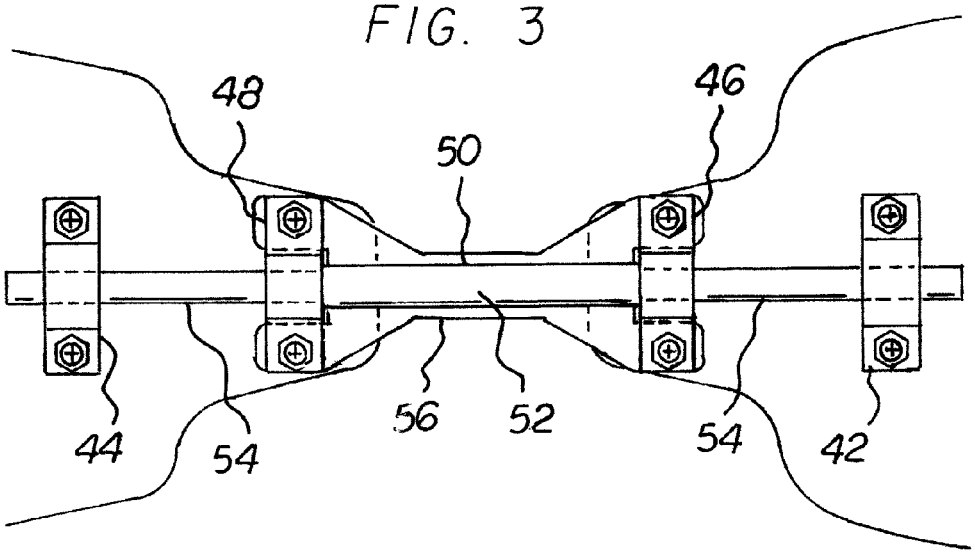
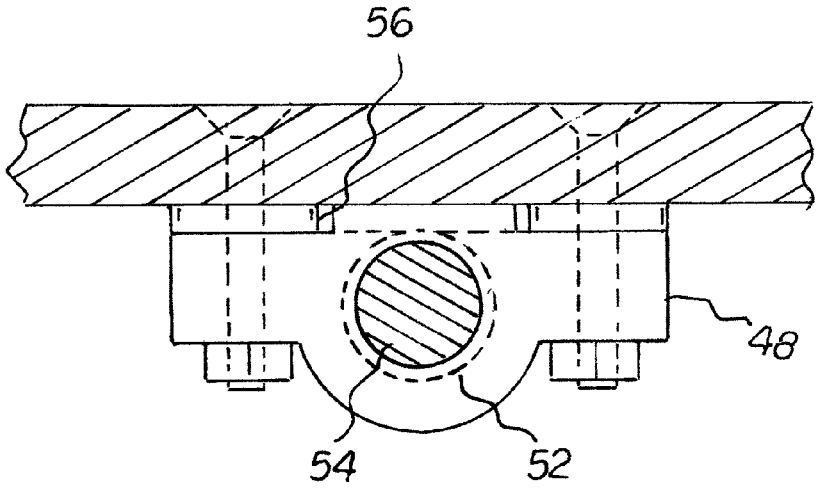
FIG. 4

LARGE WHEEL, LOW CENTER OF GRAVITY CASTERBOARD SYSTEM

BACKGROUND OF THE INVENTION

1. Field of the Invention

The present invention relates to a large wheel, low center of gravity casterboard system and more particularly pertains to mounting easier, riding smoother, abating abrupt stops, supporting greater loads, and bracing better, the mounting and riding and abating and supporting and bracing being done in a safe, convenient and economical manner.

2. Description of the Prior Art

The use of casterboards of known designs and configurations is known in the prior art. More specifically, casterboards of known designs and configurations previously devised and utilized consist basically of familiar, expected, and obvious structural configurations, notwithstanding the myriad of designs encompassed by the crowded prior art which has been developed for the fulfillment of countless objectives and requirements. Consider for example the casterboard disclosed in U.S. Pat. No. 4,082,306 issued to Sheldon and entitled Torsion Bar Skateboard. Consider also the casterboard disclosed in U.S. Pat. No. 7,195,259 issued to Gang and entitled Skateboard with Direction-Control.

While known devices fulfill their respective, particular objectives and requirements, they do not describe a large wheel, low center of gravity casterboard system that allows mounting easier, riding smoother, abating abrupt stops, supporting greater loads, and bracing better in a safe, convenient, and economical manner.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

Therefore, it can be appreciated that there exists a continuing need for a new and improved large wheel, low center of gravity casterboard system which can be used for mounting easier, riding smoother, abating abrupt stops, supporting greater loads, and bracing better in a safe, convenient, and economical manner. In this regard, the present invention substantially fulfills this need.

SUMMARY OF THE INVENTION

In view of the disadvantages inherent in the known types of casterboards of known designs and configurations now present in the prior art, the present invention provides an improved large wheel, low center of gravity casterboard system. As such, the general purpose of the present invention, which will be described subsequently in greater detail, is to provide a new and improved large wheel, low center of gravity casterboard system and method which has all the advantages of the prior art and none of the disadvantages.

To attain this, the present invention, in the broadest context includes a forward board, a rearward board, a connector/torque assembly, a forward wheel, and a rearward wheel. In this broad context, first provided is a forward board. The forward board has a forward foot placement section. The forward board has a wheel arch section. The wheel arch section has a high point. The forward board has a forward caster mount section. The forward caster mount section extends rearwardly and upwardly from the forward end of the forward board. A rearward board is provided. The rearward board has a rearward foot placement section. The rearward board also has a rearward caster mount section. The rearward caster mount section extends forwardly and downwardly from the rearward end of the rearward board. Also provided is a connector/torque assembly. The connector/torque assembly couples the forward board and rearward boards. The connector/torque assembly includes a longitudinal pivot/connecting rod. The connector/torque assembly further includes a torsion spring. Further provided is a forward wheel. The forward wheel has a forward caster. The forward wheel is rotatable about a first axis. The first axis is positioned beneath the high point of the front wheel arch section. Provided last is a rearward wheel. The rearward wheel has a rearward caster. The rearward wheel is rotatable about a third axis. The axis of the rearward wheel is positioned rearwardly of the rearward board. Such components are individually configured and correlated with respect to each other so as to attain the desired objective.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the invention be regarded as including such equivalent constructions insofar as they do not depart from the spirit and scope of the present invention.

It is therefore an object of the present invention to provide a new and improved large wheel, low center of gravity casterboard system which has all of the advantages of the prior art casterboards of known designs and configurations and none of the disadvantages.

It is another object of the present invention to provide a new and improved large wheel, low center of gravity casterboard system which may be easily and efficiently manufactured and marketed.

It is further object of the present invention to provide a new and improved large wheel, low center of gravity casterboard system which is of durable and reliable constructions.

An even further object of the present invention is to provide a new and improved large wheel, low center of gravity casterboard system which is susceptible of a low cost of manufacture with regard to both materials and labor, and which accordingly is then susceptible of low prices of sale to the consuming public, thereby making such large wheel, low center of gravity casterboard system economically available to the buying public.

Lastly, another object of the present invention is to provide a large wheel, low center of gravity casterboard system for mounting easier, riding smoother, abating abrupt stops, supporting greater loads, and bracing better in a safe, convenient, and economical manner.

These together with other objects of the invention, along with the various features of novelty which characterize the invention, are pointed out with particularity in the claims annexed to and forming a part of this disclosure.

For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a bottom view of a central section taken along line 3-3 of FIG. 1.

FIG. 4 is a cross sectional view taken along line 4-4 of FIG. 1.

The same reference numerals refer to the same parts throughout the various Figures.

DESCRIPTION OF THE PREFERRED EMBODIMENT

Figure 1:
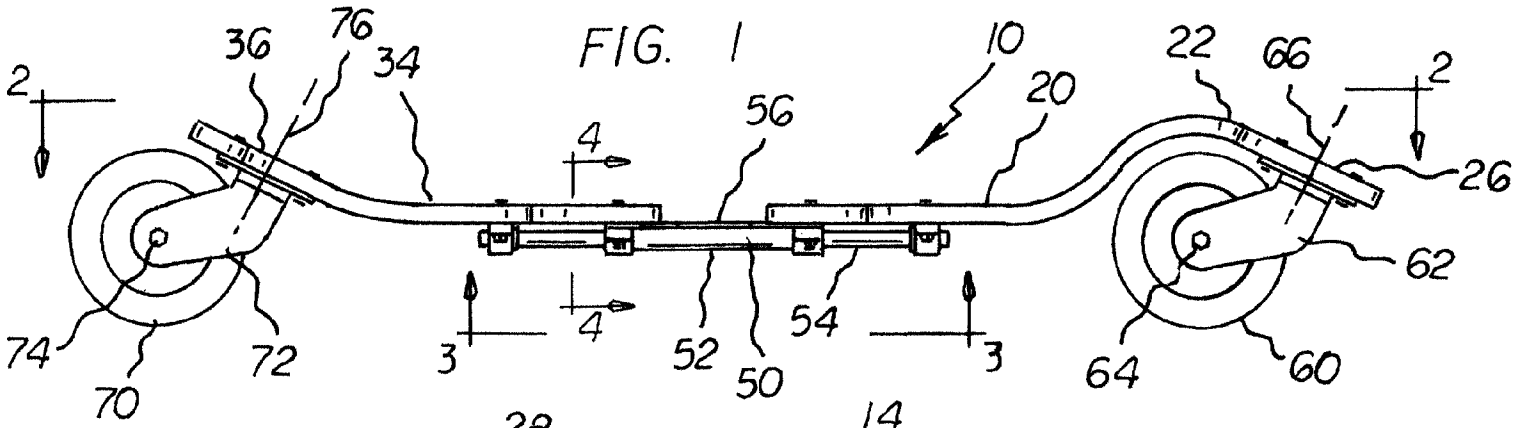
FIG. 1 is a side elevational view of a large wheel, low center of gravity casterboard system constructed in accordance with the principles of the present invention.
Figure 2:
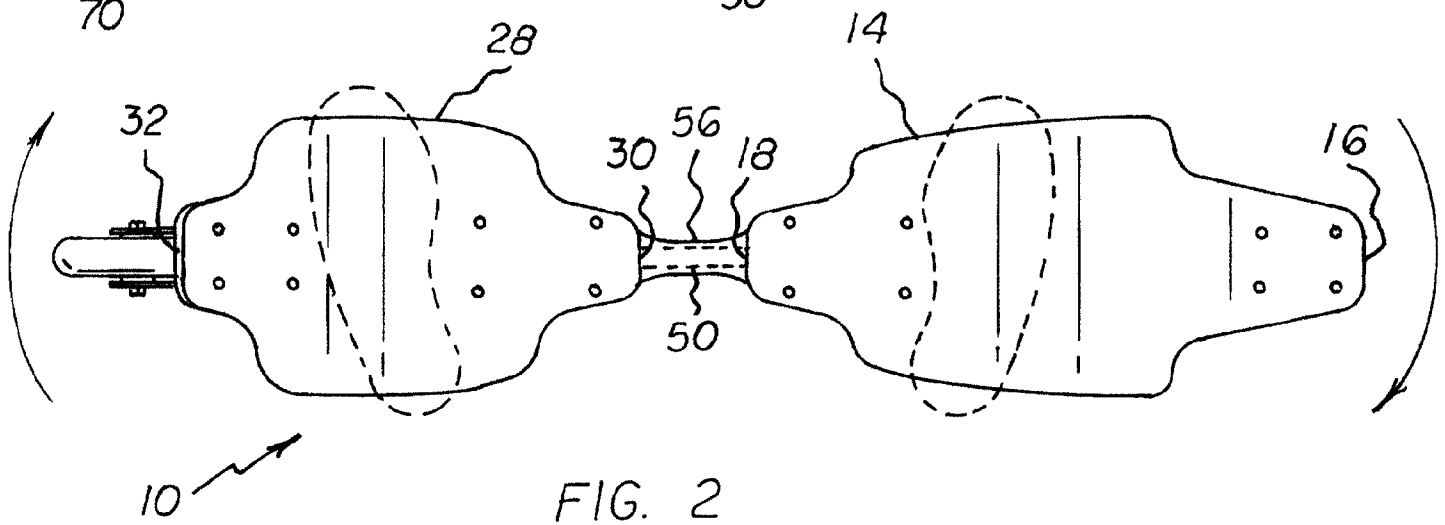
FIG. 2 is a plan view of the system shown in FIG. 1.
Figure 5:
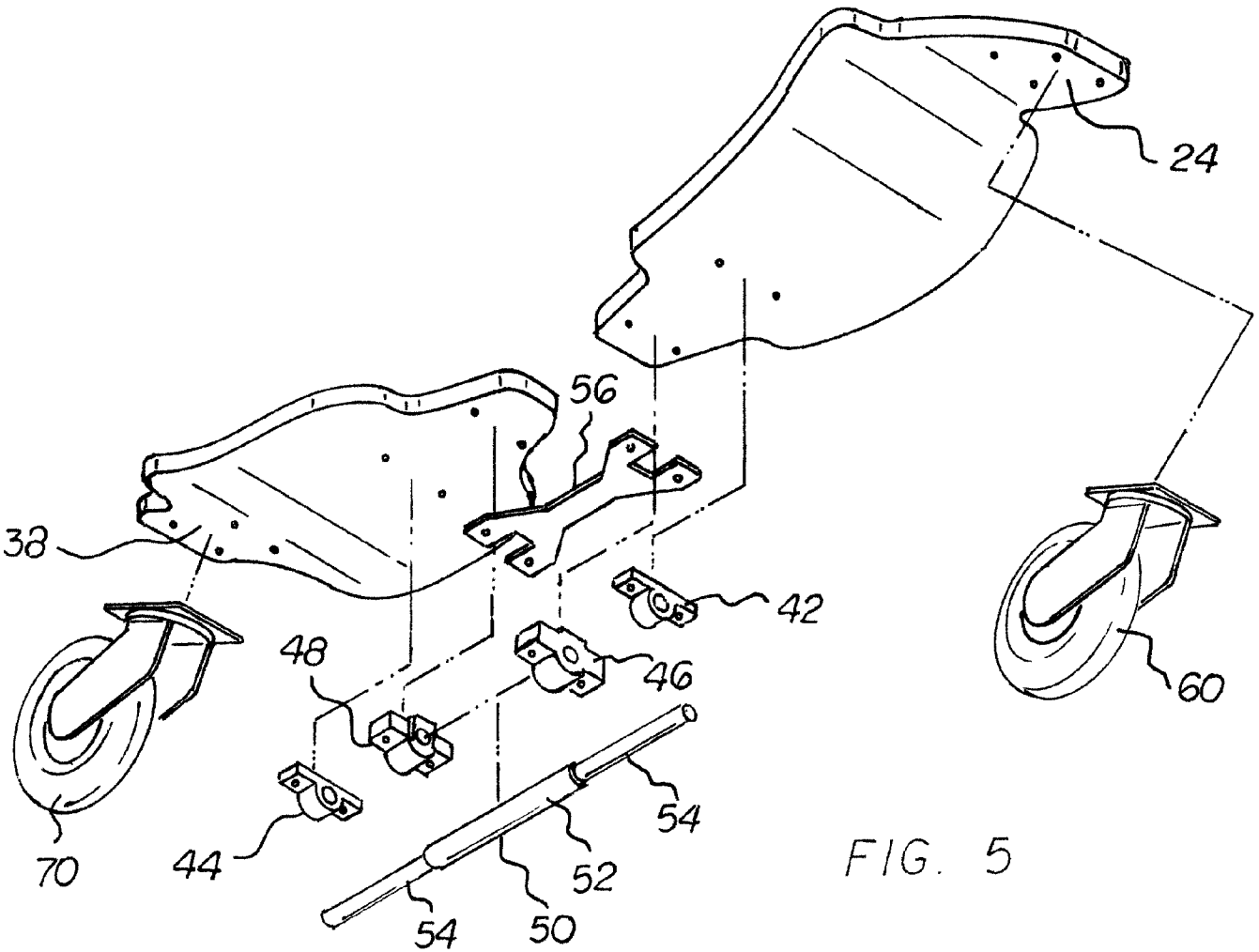
FIG. 5 is an exploded perspective illustration of the system shown in the prior Figures.

With reference now to the drawings, and in particular to FIG. 1 thereof, the preferred embodiment of the new and improved large wheel, low center of gravity casterboard system embodying the principles and concepts of the present invention and generally designated by the reference numeral 10 will be described.

The present invention, large wheel, low center of gravity casterboard system 10 is comprised of a plurality of components. Such components in their broadest context include a forward board, a rearward board, a connector/torque assembly, a forward wheel on a forward caster, and a rearward wheel on a rearward caster. Such components are individually configured and correlated with respect to each other so as to attain the desired objective.

From a specific standpoint, in the preferred embodiment of the large wheel, low center of gravity casterboard system, designated by reference numeral 10, first provided is a forward board 14. The forward board has an upper surface. The forward board has lower surface. The upper surface and lower surface are separated by a thickness. The forward board has a forward end 16. The forward board also has a rearward end 18. The forward end and the rearward end are separated by a length. The forward board has a planar forward foot placement section 20. The forward foot placement section extends forwardly from the rearward end of the forward board. The forward board has a forward caster mount section 26. The forward board has a front wheel arch section 22. The front wheel arch section extends rearwardly from the forward end of the forward board. The front wheel arch section has a high point. The lower surface of the forward board, adjacent to the forward end of the forward board, is in a planar configuration. In this manner a forward caster mount 24 is constituted. The forward caster mount extends rearwardly and upwardly from the forward end of the forward board. The forward caster mount extends at an acute angle from horizontal.

Provided next is a rearward board 28. The rearward board has an upper surface. The rearward board also has a lower surface. The upper surface and the lower surface are separated by a thickness. The rearward board has a forward end 30. The rearward board also has rearward end 32. The forward end and the rearward end are separated by a length. The rearward board has a planar rearward foot placement section 34. The rearward foot placement section extends rearwardly from the forward end of the rearward board. The rearward board has a rearward caster mount section 36. The rearward caster mount section extends forwardly and downwardly from the rearward end of the rearward board. The lower surface of the rearward board, adjacent to the rearward end of the rearward board, is in a planar configuration. In this manner a rearward caster mount 38 is constituted. The rearward caster mount extends forwardly and downwardly from the rearward edge of the rearward board. The rearward caster mount extends at an acute angle from horizontal. The forward board and the rearward board are fabricated of a material chosen from the class consisting of wood, plastic, fiberglass, and other composites.

Also provided is a connector/torque assembly. The connector/torque assembly couples the forward board and the rearward board. The connector/torque assembly includes a forward rod housing 42. The forward rod housing is attached to the lower surface of the forward board at a central region of the forward foot placement section. The connector/torque assembly includes a rearward rod housing 44. The rearward rod housing is attached to the lower surface of the rearward board at a central region of the rearward foot placement section. The connector/torque assembly includes a forward rod housing/spring mount 46. The forward rod housing/spring mount is attached to the lower surface of the forward board adjacent to the rearward end of the forward board. The connector/torque assembly includes a rearward rod housing/spring mount 48. The rearward rod housing/spring mount is attached to the lower surface of the rearward board adjacent to the forward end of the rearward board.

The connector/torque assembly includes a longitudinal pivot/connecting rod 50. The longitudinal pivot/connecting rod extends through the forward and rearward rod housings. The longitudinal pivot/connector rod is rotatably secured to the forward and rearward rod housings. The longitudinal pivot/connecting rod further extends through the forward and rearward rod housing/spring mounts. The longitudinal pivot/connecting rod is rotatably secured to the forward and rearward rod housing/spring mounts. The longitudinal pivot/connecting rod has a central section 52 of an enlarged diameter and end sections 54 of a reduced diameter. The central section is longitudinally interior of the forward and rearward rod housing/spring mounts 46, 48. The end sections are longitudinally exterior of the forward and rearward rod housing/spring mounts 46, 48.

The connector/torque assembly includes a torsion spring 56. The torsion spring is in a planar, dog bone-shaped configuration. The torsion spring has a forward end. The forward end is secured to the forward rod housing/spring mount. The torsion spring also has a rearward end. The rearward end is secured to the rearward rod housing/spring mount. The spring is fabricated of a material chosen from the class consisting of Kevlar, carbon fiber, spring steel, fiberglass, and other composites. Kevlar is a trademark of E.I. Dupont deNemour, a Delaware Corporation of Wilmington, Del.

Further provided is a forward wheel 60. A forward caster 62 is provided. The forward caster rotatably supports the forward wheel. The forward wheel is rotatable about a horizontal first axis 64. The forward caster is rotatable about a second axis 66 perpendicular to the caster mount section of the forward board. The first axis is positioned beneath the high point of the front wheel arch section.

Provided last is a rearward wheel 70. A rearward caster 72 is provided. The rearward caster rotatably supports the rearward wheel. The rearward wheel is rotatable about a horizontal third axis 74. The caster is rotatable about a fourth axis 76 perpendicular to the caster mount section of the rearward board. The third axis is positioned rearwardly of the rearward board. A skateboard length is measured from the forward end of the forward board to the rearward end of the rearward board.

The foot placement section of the forward board and the foot placemen section of the rearward board are provided in a common plane. The common plane extends through the forward and rearward wheels above the first and third axes when the wheels are in a neutral forward position.

There are a large number of advantages of the present Large Wheel Low Center of Gravity, LWLCOG, Casterboard System. The current state of the art in casterboards is described by boards that are essentially constructed on a single plane. As such the wheels are mounted below the area on the boards where the rider's feet are placed. For the board to be rideable, the wheels cannot exceed a certain size otherwise balance would be too difficult. Wheel sizes for commercially available casterboard are in the range of 75 to 80 mm in diameter. The rider of these boards is thus limited to riding on very smooth surfaces. Also the rider is subject to abrupt stops when these wheels run over uneven pavement or cracks in the pavement.

The LWLCOG casterboard invention proposes a rideable casterboard with wheel diameters on the order of 2× the current state of the art. A casterboard with such large wheels rolls more smoothly than the smaller wheel version on the same pavement. Also, the larger wheels allow the board to be ridden on rougher pavement that would be impractical with the current state of the art. Finally, the larger wheels are able to roll over cracks or impediments that would cause the smaller wheel version to come to an abrupt stop.

To accommodate larger wheels and maintain rideability, the geometry of the boards is changed from the current, generally uniplanar design. To do this, the new invention accommodates the larger wheels without significantly changing the distance from the ground that the rider places his/her feet.

The first change moves the wheels outward from below the rider's feet. The rear wheel is thus placed rearward of the riders rear foot placement. The front wheel is thus placed forward of the rider's forward foot placement. The effect is to lengthen the wheelbase of the board making the board more stable. The disadvantage of a longer wheel base is the increased likelihood of bottoming out in the middle much like a limousine going over a hump in the road.

To maintain the height of the rider's position relative to the ground, the casters which connect the wheels to the boards are mounted above the plane of the rider's foot placements. This requires significant changes to the geometry of the front and rear boards which are described in further detail. The important result is that the height of the rider's foot placement occurs on a horizontal plane above the centers of the wheels and below the top of the wheels in their neutral forward riding position thus maintaining the rider's low center of gravity.

An added benefit of the improved board geometry is the upward slope of the boards at the outer edges of the foot placement areas, rearward of the rear foot placement and forward of the forward foot placement. These rises allow the rider's feet to be laterally braced, improving the rider's connection to the board for carving and turning.

The LWLCOG casterboard system is also meant to bring casterboarding to a larger audience. The current state of the art focuses on children and trick riding as done in skate parks. The new system, with its larger format opens up the market to adults and those riding for fitness and casual cruising. Finally, the LWLCOG casterboard system is a more open system that allows for users to change parts and personalize their boards unlike the plastic boards being sold currently.

With regard to how the present invention works, the basic principle of riding a casterboard involves the conversion of lateral forces on the board into forward motion. Unlike a skateboard in which the rider can place one foot on the board and kick or push off the ground with the other, the casterboard is always operated with both feet on the board.

The primary means of propelling the board forward requires that the rider create lateral forces on the board which cause the casters to rotate out of their neutral position, with the neutral position defined as the caster wheels rearward of the caster axis, and longitudinally aligned with the board. In this position the board rolls straight. When lateral force is applied to the caster/wheel assembly, the caster is forced out of its neutral position. Due to the tilt angle of the caster plane with respect to the ground, when the caster is forced out of its neutral position, the board rises slightly. The riders weight counters the rise of the board and creates resistance to the lateral force as the caster returns to its neutral position in the absence of any lateral force. The periodic or rhythmic application of lateral forces and the ensuing return to the neutral position create the vectorial forces which propel the board forward.

The rhythmic application of lateral forces can take two forms. The first and most common is caused by the rider twisting his upper body on an axis perpendicular to the ground plane. This method creates opposing forces to be applied to the front and rear boards respectively. The second is a rocking motion in which the rider oscillates both feet laterally in unison. This second method is only used when riding in a straight line.

Turning is achieved by tilting the front board and the rear board in opposite directions along the longitudinal axis of the torsion rod. To turn left, the left side of the front board is lowered with respect to the right side of the front board at the same time that the right side of the rear board is lowered with respect to the left side of the rear board. The opposite is true for a right turn. While the torsion rod permits the front and the rear board to tilt longitudinally in opposite directions, the torsion spring serves to limit the range of such tilting and forces the two boards to return to their coplanar relationship in the absence of any tilting forces applied by the rider. Note that the tilting of the boards has the effect of displacing the caster/wheel assemblies from their neutral positions. As such, actions that have the effect of turning the board can also contribute to the board's forward motion. The forces required to propel the board can happen simultaneously with the forces to turn the board and very often do.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A large wheel, low center of gravity casterboard system comprising:

a forward board having a forward foot placement section and a wheel arch section with a high point, the forward board having a forward caster mount section extending rearwardly and upwardly from the forward end of the forward board;

a rearward board having a rearward foot placement section and a rearward caster mount section extending forwardly and downwardly from the rearward end of the rearward board;

a connector/torque assembly coupling the forward board and rearward boards, the connector/torque assembly including a longitudinal pivot/connecting rod and a torsion spring;

a forward wheel with a forward caster, the forward wheel rotatable about a first axis beneath the high point of the front wheel arch section; and a rearward wheel with a rearward caster, the rearward wheel rotatable about a third axis rearwardly of the rearward board, the foot placement section of the forward board and the foot placemen section of the rearward board being in a common plane, the common plane extending through the forward and rearward wheels above the first and third axes when the wheels are in a neutral forward position.

2. The casterboard system as set forth in claim 1 wherein the forward caster mount section extends rearwardly and upwardly from the forward end of the forward board at an acute angle from horizontal.

3. The casterboard system as set forth in claim 1 wherein the rearward caster mount extends forwardly and downwardly from the rearward edge of the rearward board at an acute angle from horizontal.

4. The casterboard system as set forth in claim 1 wherein the forward board and the rearward board are fabricated of a material chosen from the class consisting of wood, plastic, fiberglass, and composites.

5. The casterboard system as set forth in claim 1 wherein the torsion spring is in a planar configuration with a forward end secured to the forward rod housing/spring mount and with a rearward end secured to the rearward rod housing/spring mount and the spring is fabricated of a material chosen from the class consisting of Kevlar, carbon fiber, spring steel, fiberglass, and composites.

6. A large wheel, low center of gravity casterboard system (10) comprising, in combination:

a forward board (14) having an upper surface and a lower surface separated by a thickness, the forward board having a forward end (16) and a rearward end (18) separated by a length, the forward board having a forward foot placement section (20) extending forwardly from the rearward end of the forward board, the forward board having a forward caster mount section (26), the forward board having a front wheel arch section (22) extending rearwardly from the forward end of the forward board, the front wheel arch section having a high point, the lower surface of the forward board, adjacent to the forward end of the forward board, being of a planar configuration. thereby constituting a forward caster mount (24), the forward caster mount extending rearwardly and upwardly from the forward end of the forward board at an acute angle from horizontal;

a rearward board (28) having an upper surface and a lower surface separated by a thickness, the rearward board having a forward end (30) and a rearward end (32) separated by a length, the rearward board having a planar rearward foot placement section (34) extending rearwardly from the forward end of the rearward board, the rearward board having a rearward caster mount section (36) extending forwardly and downwardly from the rearward end of the rearward board, the lower surface of the rearward board, adjacent to the rearward end of the rearward board, being of a planar configuration, thereby constituting a rearward caster mount (38), the rearward caster mount extending forwardly and downwardly from the rearward edge of the rearward board at an acute angle from horizontal, the forward board and the rearward board being fabricated of a material chosen from the class consisting of wood, plastic, fiberglass, and composites;

a connector/torque assembly coupling the forward board and the rearward board, the connector/torque assembly including a forward rod housing (42) attached to the lower surface of the forward board at a central region of the forward foot placement section, a rearward rod housing (44) attached to the lower surface of the rearward board at a central region of the rearward foot placement section, a forward rod housing/spring mount (46) attached to the lower surface of the forward board adjacent to the rearward end of the forward board, a rearward rod housing/spring mount (48) attached to the lower surface of the rearward board adjacent to the forward end of the rearward board, a longitudinal pivot/connecting rod (50) extending through and rotatably secured to the forward and rearward rod housings, the longitudinal pivot/connecting rod extending through and rotatably secured to the forward and rearward rod housing/spring mounts, the longitudinal pivot/connecting rod having a central section (52) of an enlarged diameter and end sections (54) of a reduced diameter, the central section being longitudinally interior of the forward and rearward rod housing/spring mounts (46), (48), the end sections being longitudinally exterior of the forward and rearward rod housing/spring mounts (46), (48);

a torsion spring (56) in a planar, dog bone-shaped configuration with a forward end secured to the forward rod housing/spring mount and with a rearward end secured to the rearward rod housing/spring mount, the spring being fabricated of a material chosen from the class consisting of Kevlar, carbon fiber, spring steel, fiberglass, and other composites;

a forward wheel (60), a forward caster (62) rotatably supporting the forward wheel, the forward wheel rotatable about a horizontal first axis (64), the caster rotatable about a second axis (66) perpendicular to the caster mount section of the forward board, the first axis being beneath the high point of the front wheel arch section; and a rearward wheel (70), a rearward caster (72) rotatably supporting the rearward wheel, the rearward wheel rotatable about a horizontal third axis (74), the caster rotatable about a fourth axis (76) perpendicular to the caster mount section of the rearward board, the third axis being located rearwardly of the rearward board, a skateboard length being measured from the forward end of the forward board to the rearward end of the rearward board;

the foot placement section of the forward board and the foot placement section of the rearward board being in a common plane, the common plane extending through the forward and rearward wheels above the first and third axes when the wheels are in a neutral forward position.

* * * * *